United States Patent [19]

Keske

[11] 3,998,190

[45] Dec. 21, 1976

[54] ROLLER FOLLOWER WITH ANTI-ROTATION RETAINER

[75] Inventor: Frank Edward Keske, Chillicothe, Ill.

[73] Assignee: Caterpillar Tractor Co., Peoria, Ill.

[22] Filed: June 13, 1975

[21] Appl. No.: 586,848

[52] U.S. Cl. ..... 123/90.5; 74/569

[51] Int. Cl.[2] ..... F01L 1/14

[58] Field of Search ..... 123/90.5; 74/569

[56] References Cited

UNITED STATES PATENTS

| | | | |
|---|---|---|---|
| 1,820,299 | 8/1931 | Church | 123/90.5 |
| 2,863,432 | 12/1958 | O'Brien | 123/90.27 |
| 3,089,472 | 5/1963 | Thompson | 123/90.5 |
| 3,101,077 | 8/1963 | Engle | 74/569 |
| 3,139,076 | 6/1964 | Flaherty | 123/90.5 |
| 3,314,303 | 4/1967 | Maat | 74/569 |
| 3,668,945 | 6/1972 | Hofmann | 123/90.5 |
| 3,795,229 | 3/1974 | Weber | 123/90.5 |
| 3,822,683 | 7/1974 | Clouse | 123/90.5 |
| 3,886,808 | 6/1975 | Weber | 123/90.5 |

*Primary Examiner*—Charles J. Myhre
*Assistant Examiner*—Daniel J. O'Connor
*Attorney, Agent, or Firm*—Phillips, Moore, Weissenberger, Lempio & Strabala

[57] ABSTRACT

A roller follower system for valves, camming devices and the like including a pair of substantially cylindrical follower members each having at least one flat surface machined thereupon. The system includes a one-piece spring material retaining means for preventing the rotation of the roller follower members during reciprocation thereof which retainer means coact with the flat surfaces of the roller follower members and which retainer means require no machining of parts for installation and use other than the roller follower members. The retainer means is generally U-shaped and has bend portions at the distal portions of its legs and reverse bends at the proximal portions of its legs for facilitating its installation and removal.

11 Claims, 4 Drawing Figures

ROLLER FOLLOWER WITH ANTI-ROTATION RETAINER

CROSS REFERENCE TO RELATED APPLICATION

This application relates to U.S. patent application Ser. No. 318,518, now U.S. Pat. No. 3,795,229, entitled ENGINE VALVE LIFTER GUIDE, filed Dec. 26, 1972 by Robert L. Webber, of common assignment herewith.

BACKGROUND OF THE INVENTION

Guide and anti-rotation devices normally prevent roller-type cam followers, such as those used as valve lifters, from rotating during reciprocation to prevent skewing of the rollers relative to the engaged cam lobe. In the past, many of such devices have been developed and were usually complex and inefficient in reducing the skewing problem or have required separate expensive machining of associated parts, such as an engine block in the case of followers used as engine valve lifters. Some examples of prior art devices of this type are disclosed in the art of record in the aforementioned related application and in U.S. Pat. Nos. 2,863,432; 3,089,472; 3,101,077; and 3,314,303.

The present invention is directed to a simple and inexpensive non-rotative follower system which requires no machining of the environmental appartus for the followers.

SUMMARY AND OBJECTS OF THE INVENTION

The instant follower system comprises a pair of roller followers which have been machined so that each has a flat surface thereupon. The roller followers are operative to reciprocate within bore means formed therefore in an engine block of the like and to engage the lobes of a cam. The system includes a spring material retainer means for engaging the flat surfaces of the roller followers and for preventing the roller followers from rotating within their reciprocation bores. The retainer means comprise a one-piece modified U-shaped member adapted to be received within the reciprocation bores for the roller followers and to engage the flat surfaces of such roller followers.

The primary object of the present invention is to provide inexpensive and efficiently operative non-rotational reciprocating roller followers.

Another object of this invention is to provide an apparatus including a retainer means made from spring material which is so shaped as to be readily installable and removable from its environmental apparatus.

A further object of the present invention is to provide a novel roller follower member having a reduced length to width ratio for reduced inertia forces during high speed reciprocation in operation.

Other objects and advantages of the present invention will become apparent from the following drawing and description.

DETAILED DESCRIPTION

Figure 1:
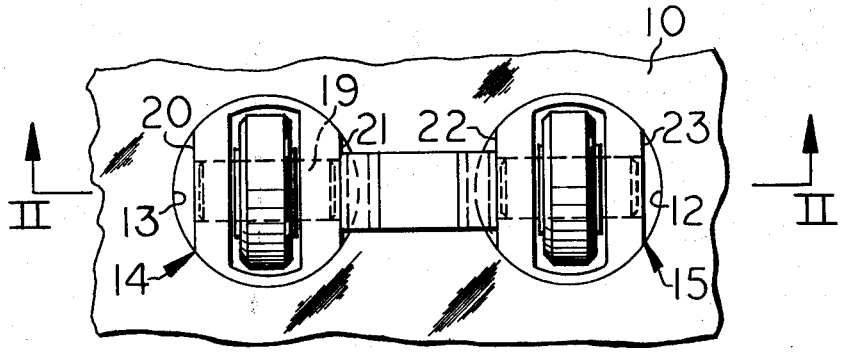
FIG. 1 is a plan view of the non-rotative roller follower system of the present invention shown installed in bores within an engine.

With reference to the drawing, the preferred embodiments of the instant invention will now be presented. The system is shown disposed within a portion of an engine block 10 as it might be utilized in connection with the actuation of engine valves. The engine block has a plurality of cylindrical bores 12, 13 defined herein for receiving reciprocating roller follower members, shown generally at 14, 15. Each of such members includes a generally cylindrical body portion 16 with a hollowed out central portion 17 within which is dispoed a roller 18 adapted to engage a camming surface (not shown). The roller 18 is mounted upon a shaft 19 journaled within the body portion 16 in suitable apertures. Each of the roller follower members has at least one flat surface machined thereupon such as are shown at 20, 21, 22, 23.

Figure 2:
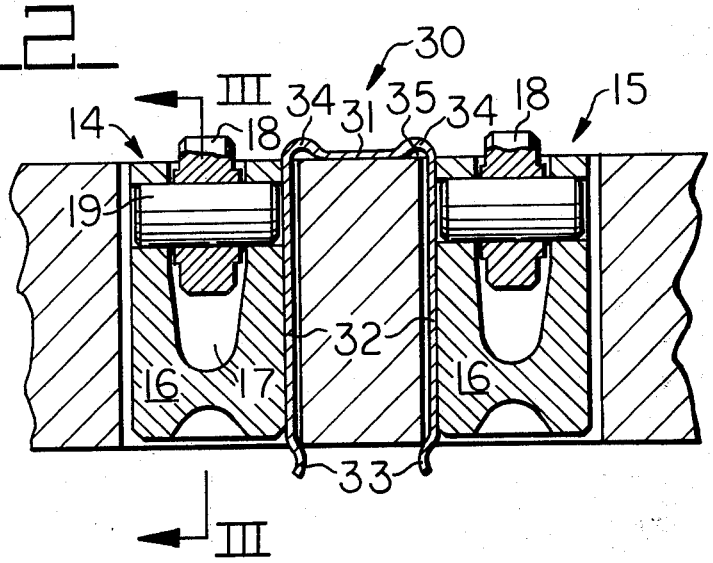
FIG. 2 is a cut-away sectional elevation taken along the line II—II of FIG. 1.
Figure 3:
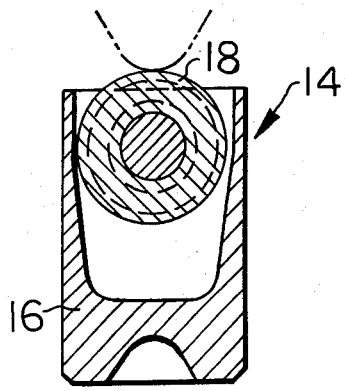
FIG. 3 is a partial sectional view of an individual roller follower taken along the line III—III of FIG. 2.

The system also includes a one-piece retainer member, shown generally at 30, for preventing the rotation of the roller followers 14, 15 as they reciprocate within their bores 12, 13. The retainer means, fabricated from spring material such as steel or the like, is generally U-shaped and includes a base portion 31 disposed on one side of block 10 and a pair of leg portions 32. As may be readily appreciated from the drawing, with the retainer 30 inserted within the follower bores 12 and 13 to straddle the bridging portion of block 10 therebetween, as shown in FIG. 2, the leg portions 32 bear against the flats 21, 22 of the roller followers 14, 15 and effectively prevent rotation of such elements within the bores.

The retainer means 30 also included a pair of hook bends 33 at the distal ends of the leg portions which bends act as installation facilitating camming surfaces during the insertion of the retainer within the bores. The hook bends further function as retaining means engaging a second side of the block for preventing upward axial movement of the retainer means relative to the block. The retainer means also includes a pair of reverse bends 34 at the proximal portions of the legs to provide gaps 35 between the engine portion 10 and the retainer means for the insertion of a removal tool when extraction of the retainer means is desired.

Figure 4:
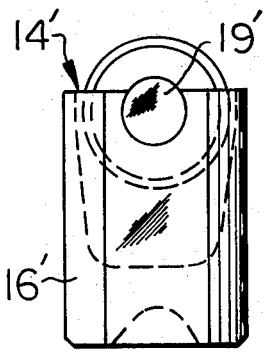
FIG. 4 is a view similar to FIG. 3, showing an alternate embodiment of a roller follower.

In FIG. 4, an alternate embodiment of the roller follower member is shown at 14'. In such embodiment, the length of the body portion 16' is reduced so that the roller shaft 19' is not completely surrounded by the journaling apertures as in the case of the primary embodiment. However, such shaft is sufficiently journaled within the body 16' to prevent dislodgement during reciprocation. The shortened follower of FIG. 4 provides reduced inertia forces during high speed reciprocation in certain applications.

The preferred embodiments of the invention have thus been illustrated and described. It must be understood that these preferred embodiments are capable of variation and modification and are not limited to the precise details set forth. This invention includes all such variations and modifications as fall within the scope of the appened claims.

I claim:

1. A non-rotative reciprocating roller-follower system including; roller-follower means for transmitting force and motion from a source thereof to a point of utilization, said roller-follower means including at least a first body member having roller means mounted for rotation thereupon, said first body member having at least one flat surface thereupon, bore means for receiving said roller-follower means and for permitting the reciprocation of said roller-follower means therein, anti-rotation retainer means for engaging said at least one flat surface during reciprocation of said body member in said bore means and preventing the rotation of said body member during reciprocation thereof, said retainer means being disposed within said bore means concurrently with said body member and said retainer means including at least one flat retainer surface for operatively engaging and coacting with said flat surface of said body member to prevent said rotation of said body member, said anti-rotation retainer means comprising a single element of flat spring material being substantially U-shaped and having a base portion and a pair of leg portions extending substantially normally from said base portion and bend means at the distal portions of said pair of leg portions for facilitating the insertion of said single element in said bore means and for retaining said single element in said bore means.

2. The invention of claim 1 wherein said first body member is cylindrical in shape with said at least one flat surface being machined thereupon, and wherein said bore means are cylindrical in shape.

3. The invention of claim 2 wherein said roller means include a shaft journaled within a pair of apertures in said body member and a roller member mounted upon said shaft.

4. The invention of claim 1 including reverse bend means at the proximal portions of said leg means contiguous with said base portion for creating raised portions adapted to receive tool means for facilitating removal of said retainer means from said bore means.

5. The invention of claim 3 wherein said pair of apertures in said body member are closed circular holes and said shaft is supported in said holes within the longitudinal confines of said body member.

6. The invention of claim 3 wherein said pair of apertures in said body member comprises a pair of partially circular-partially open cut-away portions of said body member and wherein said shaft is disposed within said cut-away portions and extends at least partially beyond the longitudinal confines of said body member.

7. The invention of claim 4 wherein said bore means include first and second adjacently disposed cylindrical bores.

8. The invention of claim 7 wherein said roller-follower means include two body members one of which is disposed for reciprocation within each of said first and second cylindrical bores, and one of said pair of leg means is disposed within each of said first and second cylindrical bores for operative engagement with the flat surfaces on each of said two body members.

9. In combination with an engine block having at least one pair of bores defined therein and on either side of a bridging portion thereof, a non-rotating roller-follower system comprising a roller-follower means reciprocally mounted in each of said bores, at least one flat surface formed on each of said roller-follower means to extend axially thereon, and a one-piece anti-rotation means for preventing rotation of each of said roller-follower means relative to said block comprising a U-shaped member having a pair of leg portions straddling the bridging portion of said block and extending through a respective one of said bores to engage the flat surface formed on a respective one of said roller-follower means for preventing rotation thereof relative to said block, a base portion disposed on one side of the bridging portion of said block and interconnected between said leg portions and retaining means formed on each of said legs and engaging a second side of said block for preventing axial movement of said anti-rotation means relative to said block.

10. The invention of claim 9 wherein said retaining means comprises a hook bend formed on a distal end of each of said leg portions.

11. The invention of claim 9 further comprising a reverse bend formed at a proximal end of each of said leg portions to define a gap between the bridging portion of said block and said member adapted to have a removal tool inserted therein.

* * * * *